US005850910A

United States Patent [19]

Broyles et al.

[11] Patent Number: 5,850,910

[45] Date of Patent: Dec. 22, 1998

[54] DISPOSABLE ARTIST PALETTE

[75] Inventors: James H. Broyles, Loveland; William D. Broyles, Pleasant Plains, both of Ohio

[73] Assignee: Wingate Packaging, Inc., Cincinnati, Ohio

[21] Appl. No.: 783,449

[22] Filed: Jan. 16, 1997

[51] Int. Cl.[6] ..... B05C 17/00

[52] U.S. Cl. ..... 206/1.8; 206/562; 229/198.2; 119/856

[58] Field of Search ..... 206/1.7, 1.8, 562, 206/564, 561; 229/198.2; 248/444, 459; 434/103; 220/914, DIG. 5; 119/856, 858, 863; D30/152

[56] References Cited

U.S. PATENT DOCUMENTS

| | | | |
|---|---|---|---|
| 3,036,554 | 5/1962 | Johnson | 119/96 |
| 3,519,190 | 7/1970 | Achermann et al. . | |
| 3,758,065 | 9/1973 | Ranseen | 248/459 |
| 3,856,136 | 12/1974 | Governale . | |
| 4,200,057 | 4/1980 | Agar | 119/96 |
| 4,653,645 | 3/1987 | Thomas | 206/564 |
| 5,004,147 | 4/1991 | Benaime | 229/198.2 |
| 5,012,764 | 5/1991 | Fick et al. | 119/106 |
| 5,133,295 | 7/1992 | Lippincott | 119/96 |
| 5,152,398 | 10/1992 | Forestal et al. | 206/562 |
| 5,184,750 | 2/1993 | Moller | 206/562 |
| 5,361,932 | 11/1994 | Friedrich | 206/217 |
| 5,425,455 | 6/1995 | Miller et al. | 206/562 |
| 5,551,593 | 9/1996 | Wiens | 220/914 |
| 5,607,077 | 3/1997 | Torkelson | 206/217 |
| 5,634,568 | 6/1997 | Wawrzyniak | 220/914 |

*Primary Examiner*—Paul T. Sewell
*Assistant Examiner*—Nhan T. Lam
*Attorney, Agent, or Firm*—Wood, Herron & Evans, L.L.P.

[57] ABSTRACT

An artists' disposable palette (10) comprising a paperboard blank (26) having a peripheral edge (16) and a hole (14) formed centrally therein. The blank (26) has a first cut line (28) extending between the hole (14) and the peripheral edge (16) of the blank (26) defining first (30) and second (32) sections of the blank adjoining along the cut line. A tab (34) in the first section (30) is inserted into a second cut line (40) in the second section (32) cupping the planar blank into a saucer shaped palette. The palette (10) is held in a saucer shape by the engagement of the tab (34) with the tab receiving slit (40) preventing the tab from passing back through the slit.

19 Claims, 2 Drawing Sheets

DISPOSABLE ARTIST PALETTE

FIELD OF THE INVENTION

This invention relates to artists' palettes for holding paint, more particularly the invention relates to a disposable palette which is irregularly shaped and may be held by the artist with one hand.

BACKGROUND OF THE INVENTION

Palettes are used by artists to hold paint. The artist holds the palette in one hand while holding a paint brush in the other hand. The artist uses the palette to temporarily hold the paint close to the artist's body while the artist moves relative to the painting surface. The palette enables the artist to temporarily store different color paints and provides a mixing surface on which the different colors may be mixed to create other colors. The artist is able to move the palette easily with his or her non-painting hand enabling the artist to move the palette relative to the painting surface in order to more easily add paint as the artist deems it necessary.

One known type of palette is rectangular and has cup-shaped indentations for storing different color paints. These palettes may be made of glass or other material which is washable and may be reused over and over again. However, these types of reusable palettes are expensive relative to the cost of disposable palettes and require a great deal of time and effort to clean.

Disposable palettes are known in the art which may be used once and then discarded. These disposable palettes are typically made of a cheaper material than the non-disposable palettes. U.S. Pat. No. 3,856,136 discloses a book of disposable palettes bound along one edge which may be torn off one at a time and used. Each of these palettes has a hole therein and a recess so that the palette may be grasped between the thumb and fingers by an artist. These planar disposable palettes must be made of a strong, relatively thick material in order to support the weight of the different globs of paint on the palette while the palette is being held by the artist in his or her non-painting hand. Because the palette must be strong enough to support the weight of the paint on the upper surface of the palette, the material of which the palette may be made is limited to certain materials and the material must be of at least a predetermined thickness. Therefore a need exists for a disposable palette which may be made of a material which is thinner and weighs less than heretofore known planar disposable palettes.

SUMMARY OF THE INVENTION

The present invention provides a disposable artist's palette which overcomes the above-mentioned drawbacks. To this end and in accordance with the principles of the present invention, a palette is provided by a flat paperboard blank having a peripheral edge and a hole formed centrally therein with a first cut line extending between the hole and the peripheral edge of the palette to define first and second sections of the paperboard blank adjoining along the first cut line. An eared tab is integrally formed on the first section by the shape of the cut line. A second cut line is formed in the second section to define a tab receiving slit sized to receive the tab of the first section. The paperboard blank is relatively thin and flat to facilitate shipping. However, the blank may be separated along the cut line and formed into a strong saucer shaped palette by pulling the sections into overlying relationship and inserting the tab of the first section into the tab receiving slit of the second section to hold that relationship.

The saucer shaped palette has a concave upper surface and a convex lower surface thus improving the strength of the palette and enabling the palette to be made of a lesser strength material and of a lesser thickness than heretofore known planar disposable palettes.

The body of the palette extends upwardly from the hole in the palette to a peripheral edge of the palette which is generally outwardly curved except for an inwardly directed curve near the cut line to define an indented portion of the palette which is adapted to receive the chest or stomach of an artist. The hole in the palette is adapted to receive the thumb of the artist.

The material of the blank may be clay coated news back (CCNB) approximately twenty-four thousandths of an inch thick. Alternatively, the blank may be solid bleach sulfide or solid unbleached sulfide. At least the upper surface of the blank is advantageously poly-coated with low density polyethylene (LDPE) to facilitate supporting the paint without adverse affect. When CCNB is used as the paperboard, the LDPE coating on the upper surface is typically clear. Further the lower surface may be provided with a white-tinted LDPE polycoat layer so that the palette may be formed in the inverse manner and still provide an artist's working surface for the paint.

By virtue of the foregoing, there is thus provided a disposable palette of a relatively thin paperboard material which may be shipped in a flat condition and quickly and easily formed into a saucer shaped disposable palette by overlapping two adjacent sections and inserting a tab into a tab receiving slit. These and other objects and advantages of the present invention shall be made apparent from the accompanying drawings and description thereof.

BRIEF DESCRIPTION OF THE DRAWINGS

The accompanying drawings, which are incorporated in and constitute a part of this specification, illustrate an embodiment of the invention and, together with a general description of the invention given below, serve to explain the principles of the invention.

DETAILED DESCRIPTION OF THE DRAWINGS

Figure 1:
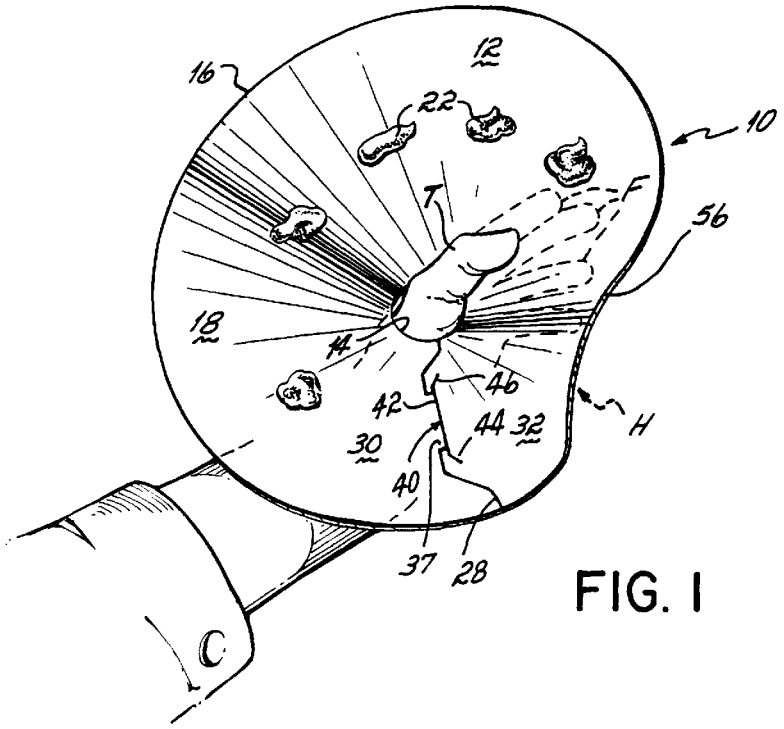
FIG. 1 is a perspective view of the palette of the present invention in its non-planar form supporting multiple globs of paint and being held by one artist.

Referring to FIG. 1, a palette 10 is illustrated being held in the left hand H of an artist. The palette 10 has a continuous inclined body 12, a thumb hole 14 adapted to receive the thumb T of the artist's hand H and a peripheral edge 16. When in use by an artist, the palette is generally saucer shaped having a concave upper surface 18 and a convex lower surface 20 (see FIG. 4). When in use, the palette 10 supports a plurality of individual globs of paint 22 placed selectively around the body 12 of the palette on the upper surface 18 with the body 12 resting on the artist's fingers F (shown in dotted line) underneath the convex lower surface 20 of the palette.

Figure 2:
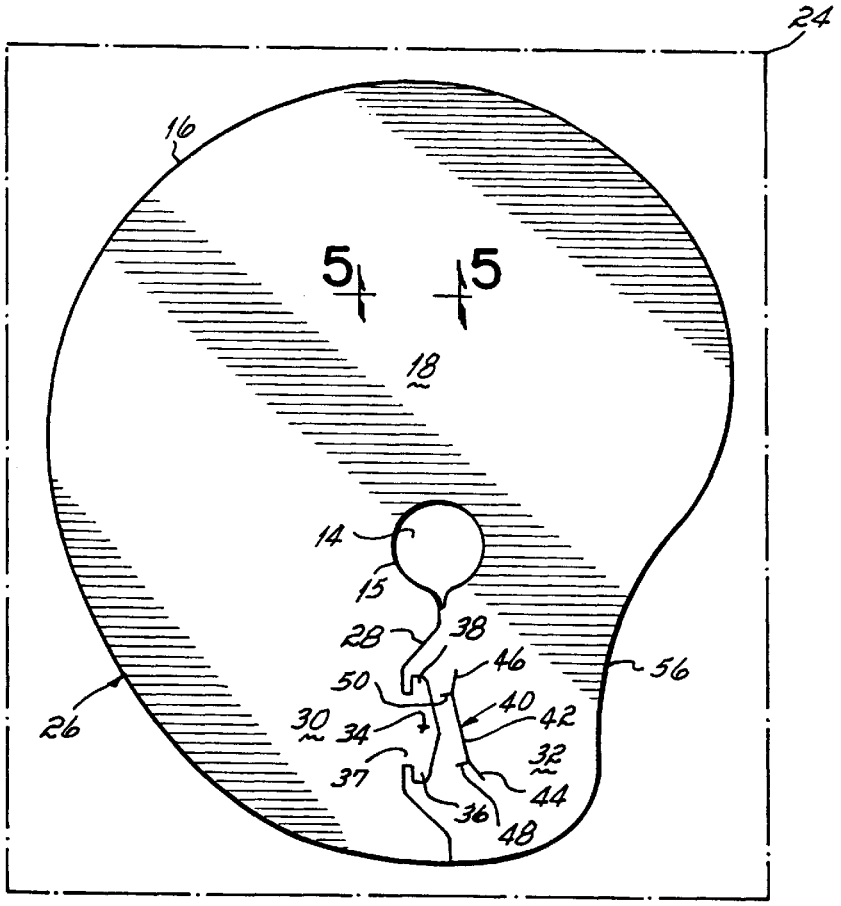
FIG. 2 is a top view of a blank in its planar form, cut from a rectangular piece of paperboard by which to form the palette of FIG. 1.

Referring to FIG. 2, the palette of the present invention is formed by taking a rectangular piece of paperboard 24 (such as cardboard) and cutting it so as to form a planar paperboard blank 26 generally in the shape of a kidney. A centrally located thumb hole 14 is cut into the blank and a first cut line 28 is cut between the edge 15 of the thumb hole 14 to the nearby lowermost aspect of peripheral edge 16 of the blank in an irregular pattern so as to define a first section 30 and a second section 32 to either side of cut line 28. The first and second sections 30, 32 adjoin each other along the first cut line 28. Due to the nature of the cut line 28, an eared tab 34 is integrally formed in the first section 30. The tab 34 has two opposed ears 36 and 38 and a throat 37, the throat defining the narrowest portion of the tab 34. A second cut line 40 is cut in the second section 32 so as to define a tab receiving slit 40 comprising a linear portion 42 and two end portions 44 and 46 diverging from the opposed ends of the linear portion 42. In order to facilitate insertion of the tab into the slit 40 and make the slit 40 easier to open, two additional cuts 48 and 50 of a lesser length then the length of the linear portion 42 are made essentially perpendicular to the linear portion 42. Due to the nature of the cut line 28, the throat 37 of the tab is approximately the same width as the length of the linear portion 42 of the tab receiving slit 40.

The peripheral edge 16 of the palette blank 26 also has an indented portion comprising an inwardly curved peripheral edge portion 56 generally parallel to first cut line 28 and adapted to be placed against the chest or stomach (not shown) of the artist when the palette is in use. The distance between the peripheral edge portion 56 to the thumb hole 14 is advantageously less than the distance between the thumb hole 14 to any other portion of the peripheral edge 16 of the palette.

The blank 26 cut from the rectangular piece of cardboard 24 is illustrated in FIGS. 1 and 2 as being adapted to be used by the left hand of the artist so that the artist may paint with his or her right hand. In this regard, section 30 overlies section 32.

However, if the artist paints with his or her left hand, the blank could be cut exactly the same and simply inverted, by pulling section 32 overtop of section 30 instead, thereby reversing the upper and lower surfaces and thus enable the blank to be easily grasped by the artist's right hand. Thus, the palette of the present invention may be used by either a right-handed or a left-handed artist.

Figure 3:
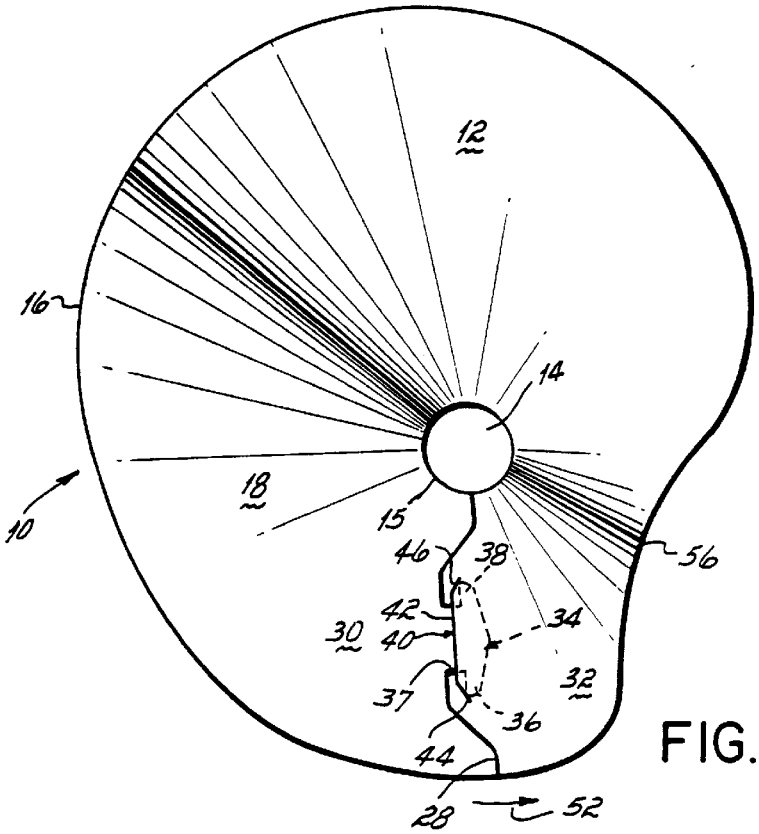
FIG. 3 is a top view of the palette of FIG. 1 with the tab inserted into the slit so to incline the body of the palette.

In order to form the saucer shaped palette 10 of the present invention, the first and second sections 30, 32 are separated from one another along first cut line 28 (such as by pushing down on the second section 32 and up on the first section 30). The tab receiving slit 40 is then opened by pushing down on a portion of the second section 32. The first section 30 is then moved toward the second section 32 above the second section in the direction of arrow 52 (see FIG. 3) so the first and second sections are in an overlying relationship and tab 34 passed through the tab receiving slit 40.

Figure 4:
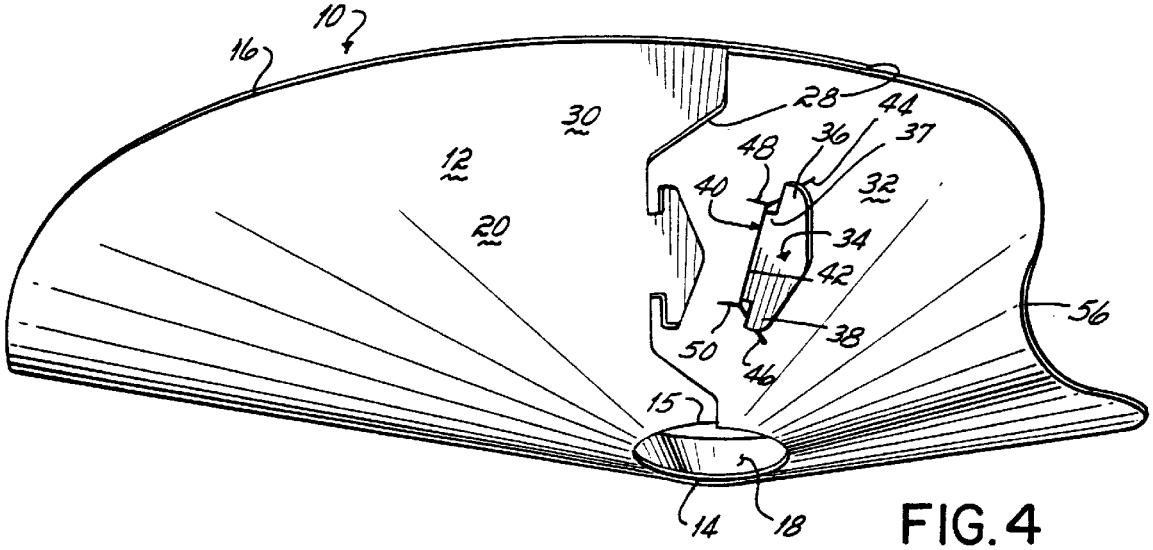
FIG. 4 is a bottom perspective view of the palette of FIG. 1 showing the tab of the first section inserted through the slit in the second section.

As illustrated in FIG. 4, the tab 34 passes through the tab receiving slit 40 and rests underneath the second section 32 of the palette. The ears 36, 38 of the tab 34 protrude beyond the linear portion 42 of the tab receiving slit 40 preventing the tab 34 from passing back through the tab receiving slit 40. The ears 36, 38 of the tab 34 hold the first and second sections 30, 32 in an overlying relation with the first section 30 lying inside of the second section 32 as best illustrated in FIG. 4. This engagement between the tab 34 and the tab receiving slit 40 enables the palette to maintain its saucer shape with a concave upper surface and a convex lower surface.

Due to their configuration and design, the palette blanks may be shipped in a planar condition thus saving space and money. The palette blanks may be easily formed into saucer-shaped palettes by the one step process of engaging the tab with the tab receiving slit described hereinabove. The saucer shape of each palette once the tab is engaged into the slit gives the palette more strength and rigidity than a planar palette. This extra rigidity enables the blanks to be made of a thinner material than planar disposable palettes heretofore known.

Figure 5:
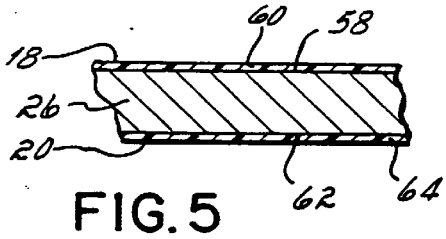
FIG. 5 is a sectional view taken along the line 5—5 of FIG. 2.

Advantageously, the blank of the present invention comprises a clay coated newsback (CCNB) approximately 24 thousandths of an inch thick. As seen in FIG. 5, the upper surface 58 of CCNB 26 is polycoated with a layer 60 of low density polyethylene (LDPE) approximately 0.0005 inches thick. CCNB usually presents a white upper surface 58, so layer 60 may be clear. Additionally, the lower surface 62 of CCNB may be provided with a similar layer 64 of polycoat; although layer 64 may be dyed white. Alternatively to CCNB, solid bleach sulphide, solid unbleached sulfide or other similar materials may be used to form the blank and provided with similar polycoat layer(s).

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. For example, the coating material on one or both sides of the CCNB may be polypropylene, mylar or high density polyethylene along with other similar materials known in the industry. Although the upper polycoat layer has been described as being clear and the lower polycoat layer as being dyed white, either layer may be tinted, shaded or colored any color desired. The invention in its broader aspects is therefore not limited to the specific details, representative apparatus and method and illustrative examples shown and described. Accordingly, departures may be made from such details without departing from the scope or spirit of applicant's general inventive concept.

Having described the invention, what is claimed is:

1. An artist's disposable palette comprising a paperboard blank having a peripheral edge and a hole formed centrally therein, a first cut line originating at the hole and terminating at the peripheral edge of the blank to define first and second sections of the paperboard blank which sections adjoin along the cut line, a tab in the first section, said tab being defined by the first cut line, and a second cut line in the second section defining a tab-receiving slit sized to receive the tab of the first section whereby the blank may be formed into a palette by separating the sections along the first cut line and inserting the tab into the tab-receiving slit.

2. The palette of claim 1 wherein said peripheral edge of said palette has an inwardly curved portion.

3. The palette of claim 1 wherein said second section has two additional cuts extending off said slit so as to facilitate insertion of said tab into said slit.

4. The palette of claim 1 wherein said paperboard blank has an upper surface and a lower surface, the palette further comprising a polycoat layer on one of said surfaces.

5. The palette of claim 4 wherein said polycoat layer is comprised of polyethylene.

6. The palette of claim 4 wherein said polycoat layer is comprised of low density polyethylene.

7. The palette of claim 4, the polycoat layer being on the upper surface.

8. The palette of claim 4 further comprising a polycoat layer on both of the surfaces.

9. The palette of claim 4 wherein said paperboard blank is comprised of clay coated newsback.

10. The palette of claim 4 wherein said paperboard blank is comprised of solid bleached sulfide.

11. The palette of claim 4 wherein said paperboard blank is comprised of solid unbleached sulfide.

12. An artist's disposable palette comprising a paperboard blank having a peripheral edge and a hole formed centrally therein, a first cut line extending between the hole and the peripheral edge of the blank to define first and second sections of the paperboard blank which sections adjoin along the cut line, a tab in the first section, said tab being defined by the first cut line, and a second cut line in the second section defining a tab-receiving slit sized to receive the tab of the first section whereby the blank may be formed into a palette by separating the sections along the first cut line and inserting the tab into the tab-receiving slit, said tab having ears extending beyond a throat of predetermined width and said tab-receiving slit having a linear portion of a length not greater than the width of said tab throat in order to prevent said tab from becoming removed from said tab-receiving slit once inserted into said slit.

13. A palette for use by an artist, said palette having a tab in a first section and a tab-receiving slit in a second section, wherein said tab has ears extending beyond a throat of predetermined width and said tab-receiving slit has a linear portion of a length not greater than the width of said tab throat in order to prevent said tab from becoming removed from said tab-receiving slit once inserted into said tab-receiving slit.

14. The palette of claim 13 wherein said palette is made of paperboard.

15. The palette of claim 13 wherein said palette is held in position by said tab being engaged with said tab-receiving slit.

16. An artist's disposable palette comprising a generally planar paperboard blank having a peripheral edge and a hole formed centrally therein, a first cut line extending between the hole and the peripheral edge of the blank, said first cut line defining first and second sections of the paperboard blank, each section having an edge defined by and along the first cut line, said edges abutting one another along the first cut line when said palette is generally planar, said first cut line further defining a tab in the first section, a tab-receiving slit being defined in the second section, whereby the blank may be formed into a non-planar palette by separating the sections along the first cut line and inserting the tab into the tab-receiving slit.

17. An artist's disposable palette comprising a generally planar paperboard blank having a peripheral edge and a hole formed centrally therein, a first cut line extending between the hole and the peripheral edge of the blank to define first and second sections to respective sides of the first cut line, said first cut line having an irregularly shaped portion situated between said hole and said peripheral edge of said blank, said irregularly shaped portion defining a tab in the first section, and an identically shaped recess in the second section, said second section of said generally planar blank further having a tab-receiving slit sized to receive the tab of the first section whereby the blank may be formed into a non-planar palette by separating the sections along the first cut line and inserting the tab into the tab-receiving slit.

18. A method of forming a disposable palette for use by an artist in painting comprising:

providing a planar paperboard blank, said paperboard blank having a peripheral edge, cutting a hole in said blank and a first cut line originating at the hole and terminating at the peripheral edge of the blank to define first and second sections of the paperboard blank which sections adjoin along the first cut line, said first cut line further defining a tab in the first section, cutting a tab-receiving slit in the second section sized to receive the tab of the first section, and forming the planar blank into a non-planar palette by separating the sections along the first cut line and inserting the tab into the tab-receiving slit.

19. A method of forming a disposable palette for use by an artist in painting comprising:

providing a planar paperboard blank, said paperboard blank having a peripheral edge, cutting a hole in said blank, cutting said blank from said hole to said peripheral edge of said blank along a cut line to define first and second sections of the paperboard blank which sections adjoin along the first cut line, said first cut line further defining an eared tab integrally formed in the first section, cutting a tab-receiving slit in the second section sized to receive the tab of the first section, and inserting the tab into the tab-receiving slit.

* * * * *